United States Patent [19]

Takeuchi et al.

[11] 4,394,198

[45] Jul. 19, 1983

[54] WATER-IN-OIL EMULSION EXPLOSIVE COMPOSITION

[75] Inventors: Fumio Takeuchi; Masao Takahashi, both of Aichi, Japan

[73] Assignee: Nippon Oil and Fats Company, Limited, Tokyo, Japan

[21] Appl. No.: 293,094

[22] Filed: Aug. 17, 1981

[30] Foreign Application Priority Data

Aug. 25, 1980 [JP] Japan ..... 55-115819
Sep. 8, 1980 [JP] Japan ..... 55-124201

[51] Int. Cl.[3] ..... C06B 45/02
[52] U.S. Cl. ..... 149/21; 149/2; 149/46; 149/61
[58] Field of Search ..... 149/21, 46, 61, 2

[56] References Cited

U.S. PATENT DOCUMENTS

| | | | |
|---|---|---|---|
| 4,110,134 | 8/1978 | Wade | 149/2 |
| 4,216,040 | 8/1980 | Sudweeks et al. | 149/60 |
| 4,326,900 | 4/1982 | Hattori et al. | 149/89 |
| 4,331,821 | 11/1982 | Sudweeks et al. | 149/21 |

*Primary Examiner*—Stephen J. Lechert, Jr.
*Attorney, Agent, or Firm*—Parkhurst & Oliff

[57] ABSTRACT

A water-in-oil emulsion explosive composition having a remarkably improved storage stability in its initiation sensitivity in small diameter cartridges and at low temperatures is disclosed. The explosive composition comprises a disperse phase formed of an aqueous oxidizer solution consisting of (a) ammonium nitrate or a mixture of ammonium nitrate and another oxidizer salt, (b) water and (c) a specifically limited weak acid salt or condensed phosphate; a continuous phase consisting of (d) fuel oil and/or wax; (e) an emulsifier; and (f) hollow microspheres or microbubbles.

6 Claims, No Drawings

WATER-IN-OIL EMULSION EXPLOSIVE COMPOSITION

BACKGROUND OF THE INVENTION (1) Field of the Invention

The present invention relates to a water-in-oil emulsion explosive composition (hereinafter, abbreviated as W/O emulsion explosive composition), and more particularly relates to a W/O emulsion explosive composition having a remarkably improved storage stability in initiation sensitivity in small diameter cartridges and at low temperatures, which does not contain explosives, non-explosives, detonation-catalytic sensitizers or sensitive oxidizers, such as chlorate, perchlorate or the like of ammonium or alkali metal, used in conventional W/O emulsion explosive compositions for improving their initiation sensitivity, but contains a specifically limited weak acid salt or a specifically limited condensed phosphate.

(2) Description of the Prior Art

There have hitherto been known a large number of W/O emulsion explosive compositions having an improved initiation sensitivity in small diameter cartridges and at low temperatures, which contain an explosive sensitizer, such as nitroglycerine or the like, a non-explosive sensitizer, such as monomethylamine nitrate or the like (hereinafter, the above described explosive and non-explosive sensitizers are referred to as sensitive substances), a detonation-catalytic sensitizer, such as a compound of metals having an atomic number of at least 13 and being other than the metals of Groups I and II in the Periodic Table, a water-soluble strontium compound or the like, or a sensitive oxidizer, such as perchlorate or the like of ammonium or alkali metals (hereinafter, the above described detonation-catalytic sensitizer and sensitive oxidizer are referred to as auxiliary sensitive substances). However, in the production of these W/O emulsion explosive compositions, the above described sensitive substance or auxiliary sensitive substance must be transported and compounded, and are very dangerous in handling. Moreover the volatile gas generated during the production of the explosive compositions and the explosion gas generated after the use of the explosive compositions are often uncomfortable and toxic. Furthermore, the raw materials for the explosive compositions are often expensive. Accordingly, it is desirable to produce explosive compositions containing neither sensitive substances nor auxiliary sensitive substances. Under these circumstances, some W/O emulsion explosive compositions have hitherto been proposed, which do not contain the above described sensitive substances or auxiliary sensitive substances, but can be detonated in the state of a small diameter cartridge by a No. 6 or No. 8 blasting cap.

For example, U.S. Pat. No. 4,110,134 discloses that a W/O emulsion explosive composition containing glass microballoons as a gas-retaining agent can be completely detonated up to a density of maximum 1.25 in a cartridge diameter of about 1.25 inches (31.8 mm) by a No. 6 blasting cap. Further, U.S. Pat. No. 4,149,917 discloses that a W/O emulsion explosive composition, whose density has been adjusted to 0.95 by introducing microbubbles into the explosive composition without the use of gas-retaining agent, is completely detonated (explosive temperature: 21.1° C.) in a cartridge diameter of 1.25 inches (31.8 mm) by a No. 6 blasting cap even after a lapse of time of 2 months from the production of the explosive composition, and further is completely detonated (explosive temperature: 21.1° C.) in a cartridge diameter of 1.25 inches (31.8 mm) by a No. 8 blasting cap after a lapse of time of 8 months from the production of the explosive composition.

Conventional W/O emulsion explosive compositions not containing the above described sensitive substances or auxiliary sensitive substances are completely detonated in a small cartridge diameter of 1.25 inches by a No. 6 blasting cap or a No. 8 blasting cap, but still have drawbacks that the explosive compositions are insufficient in initiation sensitivity in a cartridge diameter smaller than 1.25 inches and at low temperature, and in storage stability in its initiation sensitivity.

The inventors have made various investigations in order to obviate the above described problems in the initiation sensitivity in a small cartridge diameter (for example, 1 inch) and at a low temperature of −5° C. and in the storage stability in its initiation sensitivity, and have thereby accomplished the present invention.

SUMMARY OF THE INVENTION

The feature of the present invention is the provision of a W/O emulsion explosive composition comprising a disperse phase formed of an aqueous oxidizer solution consisting of (a) ammonium nitrate or a mixture of ammonium nitrate with another inorganic oxidizer salt, (b) water and (c) a specifically limited weak acid salt or a specifically limited condensed phosphate; a continuous phase formed of a combustible material consisting of (d) fuel oil and/or wax; (e) an emulsifier; and (f) hollow microspheres or microbubbles.

DESCRIPTION OF THE PREFERRED EMBODIMENT

In the W/O emulsion explosive composition of the present invention, the aqueous oxidizer solution forms the disperse phase, and consists mainly of ammonium nitrate and contains water and a specifically limited weak acid salt or a specifically limited condensed phosphate and further contains occasionally other inorganic oxidizer salts. As the other inorganic oxidizer salts, use is made of, for example, nitrates of alkali metal or alkaline earth metal, such as sodium nitrate, calcium nitrate and the like. These inorganic oxidizer salts are used alone or in admixture. The compounding amount of ammonium nitrate is generally 40–90% by weight (hereinafter, "%" means % by weight) based on the total amount of the resulting explosive composition, and the other inorganic oxidizer salts may be occasionally added to ammonium nitrate in an amount of not more than 40% based on the total amount of the mixture of ammonium nitrate and the other inorganic oxidizer salt.

The compounding amount of water is generally 7.45–28% based on the total amount of the resulting explosive composition.

As the specifically limited weak acid salts, use is made of lithium, sodium, potassium, calcium and ammonium salts of carbonic acid, boric acid, acetic acid, silicic acid and citric acid. As the specifically limited condensed phosphates, use is made of orthophosphate represented by the general formula of $M_3PO_4$ (M represents lithium, sodium, potassium, calcium or ammonium); polyphosphate represented by the general formula of $M_{n+2}P_nO_{3n+1}$ (n represents an integer of 2, 3 or 4; the polyphosphate of n=2 is pyrophosphate, that of n=3 is tripolyphosphate and that of n=4 is tetrapolyphosphate; and M represents lithium, sodium, potassium, calcium or ammonium); metaphosphate represented by the general formula of $(MPO_3)_n$ (n is an integer of 3 or 4; the metaphosphate of n=3 is trimetaphosphate and that of n=4 is tetrametaphosphate; and M represents lithium, sodium, potassium, calcium or ammonium); and ultraphosphate represented by the general formula of $XM_2O.YP_2O_5$ ($O<(X/Y)<1$, and M represents lithium, sodium, potassium, calcium or ammonium). The condensed phosphate of the present invention further includes condensed phosphates, which are formed by replacing by hydrogen a part of lithium, sodium, potassium, calcium and ammonium represented by M in the above described general formula. These specifically limited weak acid salts and specifically limited condensed phosphates are used alone or in admixture. The compounding amount of the specifically limited weak acid salt and condensed phosphate is 0.05–15%, preferably 0.1–5%, based on the total amount of the resulting explosive composition. When the amount is less than 0.05%, the storage stability of the resulting explosive composition in its initiation sensitivity cannot be noticeably improved. When the amount is more than 15%, the amount of other components is relatively decreased, and the explosion reactivity and the like of the resulting explosive composition are poor. Therefore, the use of the specifically limited weak acid salt and condensed phosphate in an amount of less than 0.05% or more than 15% is not preferable.

The combustible material used in the W/O emulsion explosive composition of the present invention forms a continuous phase, and consists of fuel oil and/or wax. The fuel oil includes hydrocarbons, for example, paraffinic hydrocarbon, olefinic hydrocarbon, naphthenic hydrocarbon, other saturated or unsaturated hydrocarbon, petroleum, purified mineral oil, lubricant, liquid paraffin and the like; and hydrocarbon derivatives, such as nitrohydrocarbon and the like. The wax includes unpurified microcrystalline wax, purified microcrystalline wax, paraffin wax and the like, which are derived from petroleum; mineral waxes, such as montan wax, ozokerite and the like; animal waxes, such as whale wax and the like; and insect waxes, such as beeswax and the like. The fuel oil and/or wax are used alone or in admixture. The compounding amount of the fuel oil and/or wax is generally 1–10% based on the total amount of the resulting explosive composition.

The emulsifier to be used in the W/O emulsion explosive composition of the present invention is not particularly limited and includes all the emulsifiers capable of forming a W/O emulsion, for example, fatty acid esters of sorbitan, such as sorbitan monolaurate, sorbitan monooleate, sorbitan monopalmitate, sorbitan monostearate, sorbitan sesquioleate, sorbitan dioleate, sorbitan trioleate and the like; mono- or di-glycerides of fatty acid, such as stearic acid monoglyceride and the like; fatty acid esters of polyoxyethylenesorbitan, such as polyoxyethylenesorbitan monolaurate, polyoxyethylenesorbitan monostearate and the like; oxazoline derivatives; imidazoline derivatives; phosphoric acid esters; alkali or alkaline earth metal salts of fatty acid; primary, secondary or tertiary amine; and nitrates or acetates of primary, secondary or tertiary amine. These emulsifiers are used alone or in admixture. The compounding amount of the emulsifier is generally 0.5–5% based on the total amount of the resulting explosive composition.

The W/O emulsion explosive composition of the present invention is adjusted to a density of 0.80–1.35, preferably 1.00–1.15 by using a density adjusting agent. The density adjusting agent includes hollow microspheres and microbubbles. As the hollow microspheres, use is made of inorganic hollow microspheres obtained from, for example, glass, alumina, shale, shirasu (shirasu is a kind of volcanic ash), silica sand, volcanic rock, sodium silicate, borax, perlite, obsidian and the like; carbonaceous hollow microspheres obtained from pitch, coal and the like; and synthetic resin hollow microspheres obtained from phenolic resin, polyvinylidene chloride, epoxy resin, urea resin and the like. These hollow microspheres are used alone or in admixture. The compounding amount of the hollow microspheres is generally 1–10% based on the total amount of the resulting explosive composition. The microbubbles include microbubbles formed by adding a chemical foaming agent to the raw material mixture, and microbubbles formed by mechanically blowing air or other gas into the raw material mixture at the step for forming a W/O emulsion or at the step after the W/O emulsion is formed. As the chemical foaming agent, use is made of inorganic chemical foaming agents, such as alkali metal borohydride, a mixture of sodium nitrite and urea, and the like; and organic chemical foaming agents, such as N,N'-dinitrosopentamethylenetetramine, azodicarbonamide, azobisisobutyronitrile and the like. These chemical foaming agents are used alone or in admixture. The compounding amount of the chemical foaming agent is generally 0.01–2% based on the total amount of the resulting explosive composition.

The above described W/O emulsion explosive composition of the present invention has an improved storage stability due to the presence of the above described specifically limited weak acid salt or specifically limited condensed phosphate, and hence the W/O emulsion explosive composition has remarkably improved initiation sensitivity and storage stability in small cartridge diameters and at low temperatures.

The W/O emulsion explosive composition of the present invention is produced, for example, in the following manner. That is, a specifically limited weak acid salt or a specifically limited condensed phosphate is added to ammonium nitrate or to a mixture of ammonium nitrate and the other inorganic oxidizer salt, and the resulting mixture is dissolved in water at a temperature of about 80°–90° C. to obtain an aqueous solution of the oxidizer salts. An emulsifier is mixed with fuel oil and/or wax at a temperature of 80°–90° C. to obtain a melted mixture of the emulsifier and the fuel oil and/or wax (hereinafter, the mixture is referred to as "combustible material mixture"). Then, the combustible material mixture is first charged into a heat-insulating vessel having a certain capacity, and then the aqueous solution of the oxidizer salts is gradually added to the combustible material mixture while agitating the resulting mixture by means of a commonly used propeller blade-type agitator. After completion of the addition, the resulting mixture is further agitated at a rate of about 1,600 rpm for about 5 minutes to obtain a W/O emulsion kept at about 85° C. Then, the W/O emulsion is mixed with hollow microspheres or a chemical foaming agent in a vertical type kneader while rotating the kneader at a rate of about 30 rpm, to obtain a W/O emulsion explosive composition of the present invention. When it is intended to contain microbubbles by blowing air or other gases in a W/O emulsion explosive composition in place of hollow microspheres or microbubbles formed from a chemical foaming agent, the above described W/O emulsion is agitated while blowing air or other gases into the W/O emulsion, to obtain the W/O emulsion explosive composition.

The following examples are given for the purpose of illustration of this invention and are not intended as limitations thereof. In the examples, "parts" and "%" mean by weight.

EXAMPLE 1

A W/O emulsion explosive composition having a compounding recipe shown in the following Table 1 was produced in the following manner. To 54.70 parts (10.94%) of water were added 377.90 parts (75.58%) of ammonium nitrate, 22.65 parts (4.53%) of sodium nitrate and 4.80 parts (0.96%) of sodium carbonate, and the resulting mixture was heated to about 85° C. to dissolve the nitrates in water and to obtain an aqueous solution of the oxidizer salts. A mixture of 8.65 parts (1.73%) of sorbitan monooleate and 16.85 parts (3.37%) of unpurified microcrystalline wax was heated and melted to obtain a combustible material mixture kept at about 85° C. Into a heat-insulating vessel was charged the above described combustible material mixture, and then the above described aqueous solution of the oxidizer salts was gradually added to the combustible material mixture while agitating the resulting mixture by means of a propeller blade-type agitator. After completion of the addition, the resulting mixture was further agitated at a rate of about 1,600 rpm for 5 minutes to obtain a W/O emulsion kept at about 85° C. Then, the W/O emulsion was mixed with 14.45 parts (2.99%) of glass hollow microspheres having an average particle size of 75 μm in a vertical type kneader while rotating the kneader at a rate of about 30 rpm, to obtain a W/O emulsion explosive composition. The resulting W/O emulsion explosive composition was molded into a shaped article having a diameter of 25 mm and a length of about 180 mm and having a weight of 100 g, and the shaped article was packed with a viscose-processed paper to form a cartridge, which was used in the following performance tests:

(A) density measurement after one day from the production;

(B) storage stability test for initiation sensitivity, wherein such a temperature cycle that a sample cartridge was kept at 60° C. for 24 hours and then at −15° C. for 24 hours was repeated to deteriorate the sample cartridge, initiation tests of the above treated sample cartridge were effected at −5° C. by using a No. 6 blasting cap during the repeating temperature cycles until the sample cartridge was no longer detonated, and the number of the repeated temperature cycles was measured and estimated to be the number of months within which the sample cartridge was able to be stored at room temperature (10°–30° C.) while maintaining its complete detonability (this estimation is based on the experimental data that the above described one temperature cycle corresponds substantially to one month storage at room temperature); and (C) density measurement at the final complete detonation in the storage stability test in the above item (B).

The obtained results are shown in Table 1.

EXAMPLES 2–8

A W/O emulsion explosive composition having a compounding recipe shown in Table 1 was produced according to Example 1. A sample cartridge was produced from the above obtained W/O emulsion explosive composition in the same manner as described in Example 1, and subjected to the same performance tests as described in Example 1. The obtained results are shown in Table 1. In Example 8, the sample cartridge was heated in a thermostat kept at about 50° C. for 2 hours to decompose and foam the compounded chemical foaming agent (N,N'-dinitrosopentamethylenetetramine) and to adjust the density, and the above treated sample cartridge was subjected to the same performance tests as described in Example 1.

EXAMPLE 9

A W/O emulsion explosive composition having a compounding recipe shown in Table 1 was produced in the following manner. That is, a W/O emulsion was produced according to Example 1 and agitated at a rate of about 1,600 rpm for 2 minutes by means of a propeller blade-type agitator while blowing air into the emulsion through nozzles having a small diameter, to introduce microbubbles of air into the emulsion, resulting in a W/O emulsion explosive composition having a given density. A sample cartridge was produced from the above obtained W/O emulsion explosive composition in the same manner as described in Example 1, and subjected to the same performance tests as described in Example 1. The obtained results are shown in Table 1.

EXAMPLES 10–18

A W/O emulsion explosive composition having a compounding recipe shown in the following Table 2 was producing according to Example 1. A sample cartridge was produced from the above obtained W/O emulsion explosive composition in the same manner as described in Example 1, and subjected to the same performance tests as described in Example 1. The obtained results are shown in Table 2. In Example 18, the sample cartridge was heated in a thermostat kept at about 50° C. for 2 hours to decompose and foam the compounded chemical foaming agent (N,N'-dinitrosopentamethylenetetramine) and to adjust the density, and the above treated sample cartridge was subjected to the same performance tests as described in Example 1.

EXAMPLE 19

A W/O emulsion explosive composition having a compounding recipe shown in Table 2 was produced according to Example 9. A sample cartridge was produced from the above obtained W/O emulsion explosive composition in the same manner as described in Example 1, and subjected to the same performance tests as described in Example 1. The obtained results are shown in Table 2.

TABLE 1(a)

| Example | 1 | 2 | 3 | 4 | 5 | 6 | 7 | 8 | 9 |
|---|---|---|---|---|---|---|---|---|---|
| Ammonium nitrate | 75.58 | 75.58 | 75.58 | 75.58 | 75.58 | 73.10 | 71.23 | 77.66 | 77.81 |
| Sodium nitrate | 4.53 | 4.53 | 4.53 | 4.53 | 4.53 | 4.38 | 9.41 | 4.66 | 4.67 |
| Water | 10.94 | 10.94 | 10.94 | 10.94 | 10.94 | 10.58 | 11.01 | 11.24 | 11.27 |

TABLE 1(a)-continued

| | Example | 1 | 2 | 3 | 4 | 5 | 6 | 7 | 8 | 9 |
|---|---|---|---|---|---|---|---|---|---|---|
| Compounding recipe (wt. %) | Sodium carbonate | 0.96 | — | — | — | — | 2.80 | 0.29 | — | 0.99 |
| | Sodium pentaborate | — | 0.96 | — | — | — | — | — | — | — |
| | Sodium acetate | — | — | 0.96 | — | — | — | — | — | — |
| | Ammonium silicate | — | — | — | 0.96 | — | — | — | 0.99 | — |
| | Sodium citrate | — | — | — | — | 0.96 | — | — | — | — |
| | Unpurified microcrystalline wax | 3.37 | 3.37 | 3.37 | 3.37 | 3.37 | — | 3.40 | 3.47 | 3.47 |
| | Liquid paraffin | — | — | — | — | — | 3.26 | — | — | — |
| | Sorbitan monooleate | 1.73 | 1.73 | 1.73 | 1.73 | 1.73 | — | 1.75 | 1.78 | 1.79 |
| | Stearic acid monoglyceride | — | — | — | — | — | 1.68 | — | — | — |
| | Glass hollow microspheres | 2.89 | 2.89 | 2.89 | 2.89 | 2.89 | — | 2.91 | — | — |
| | Silica hollow microspheres | — | — | — | — | — | 4.20 | — | — | — |
| | N,N'—dinitrosopentamethylene-tetramine | — | — | — | — | — | — | — | 0.20 | — |

TABLE 1(b)

| | Example | 1 | 2 | 3 | 4 | 5 | 6 | 7 | 8 | 9 |
|---|---|---|---|---|---|---|---|---|---|---|
| Performance | Density after one day from production | 1.07 | 1.06 | 1.07 | 1.08 | 1.07 | 1.08 | 1.08 | 1.06 | 1.08 |
| | Storage stability in initiation sensitivity (The number of storage months while maintaining complete detonability) | 27 | 26 | 27 | 26 | 26 | 22 | 32 | 20 | 19 |
| | Density at the final complete detonation | 1.08 | 1.07 | 1.09 | 1.08 | 1.09 | 1.09 | 1.10 | 1.10 | 1.12 |

TABLE 2(a)

| | Example | 10 | 11 | 12 | 13 | 14 | 15 | 16 | 17 | 18 | 19 |
|---|---|---|---|---|---|---|---|---|---|---|---|
| Compounding recipe (wt. %) | Ammonium nitrate | 75.58 | 75.58 | 75.58 | 75.58 | 75.58 | 73.10 | 75.58 | 71.23 | 77.66 | 77.81 |
| | Sodium nitrate | 4.53 | 4.53 | 4.53 | 4.53 | 4.53 | — | 4.53 | 9.41 | 4.66 | 4.67 |
| | Calcium nitrate | — | — | — | — | — | 4.38 | — | — | — | — |
| | Water | 10.94 | 10.94 | 10.94 | 10.94 | 10.94 | 10.58 | 10.94 | 11.01 | 11.24 | 11.27 |
| | Disodium hydrogenphosphate | 0.96 | — | — | — | — | — | — | 0.29 | — | — |
| | Lithium dihydrogenphosphate | — | 0.96 | — | — | — | — | — | — | — | — |
| | Potassium pyrophosphate | — | — | 0.96 | — | — | 2.80 | 0.96 | — | 0.99 | 0.99 |
| | Ammonium metaphosphate | — | — | — | 0.96 | — | — | — | — | — | — |
| | Sodium ultraphosphate | — | — | — | — | 0.96 | — | — | — | — | — |
| | Unpurified microcrystalline wax | 3.37 | 3.37 | 3.37 | 3.37 | 3.37 | 3.26 | — | 3.40 | 3.47 | 3.47 |
| | Liquid paraffin | — | — | — | — | — | — | 3.37 | — | — | — |
| | Sorbitan monooleate | 1.73 | 1.73 | 1.73 | 1.73 | 1.73 | 1.68 | 1.73 | 1.75 | 1.78 | 1.79 |
| | Stearic acid monoglyceride | — | — | — | — | — | — | — | — | — | — |
| | Glass hollow microspheres | 2.89 | 2.89 | 2.89 | 2.89 | 2.89 | — | 2.89 | 2.91 | — | — |
| | Silica hollow microspheres | — | — | — | — | — | 4.20 | — | — | — | — |
| | N,N'—dinitrosopentamethylene-tetramine | — | — | — | — | — | — | — | — | 0.20 | — |

TABLE 2(b)

| | Example | 10 | 11 | 12 | 13 | 14 | 15 | 16 | 17 | 18 | 19 |
|---|---|---|---|---|---|---|---|---|---|---|---|
| Performance | Density after one day from production | 1.08 | 1.06 | 1.08 | 1.07 | 1.09 | 1.07 | 1.07 | 1.11 | 1.06 | 1.10 |
| | Storage stability in initiation sensitivity (The number of storage months while maintaining complete detonability) | 29 | 27 | 29 | 30 | 28 | 25 | 23 | 33 | 21 | 20 |
| | Density at the final complete detonation | 1.08 | 1.08 | 1.09 | 1.10 | 1.10 | 1.10 | 1.08 | 1.13 | 1.11 | 1.14 |

COMPARATIVE EXAMPLES 1-5

A W/O emulsion explosive composition having a compounding recipe shown in the following Table 3 was produced according to Example 1. A sample cartridge was produced from the above obtained W/O emulsion explosive composition in the same manner as described in Example 1, and subjected to the same performance tests as described in Example 1. The obtained results are shown in Table 3.

COMPARATIVE EXAMPLE 6

A W/O emulsion explosive composition having a compounding recipe shown in Table 3 was produced according to Example 9. A sample cartridge was produced from the above obtained W/O emulsion explosive composition in the same manner as described in Example 1, and subjected to the same performance tests as described in Example 1. The obtained results are shown in Table 3.

TABLE 3

| | Comparative example | 1 | 2 | 3 | 4 | 5 | 6 |
|---|---|---|---|---|---|---|---|
| Compounding recipe (wt. %) | Ammonium nitrate | 76.30 | 75.20 | 76.30 | 71.43 | 78.44 | 78.60 |
| | Sodium nitrate | 4.57 | — | 4.57 | 9.44 | 4.70 | 4.71 |
| | Calcium nitrate | — | 4.51 | — | — | — | — |
| | Water | 11.05 | 10.89 | 11.05 | 11.05 | 11.36 | 11.38 |
| | Unpurified microcrystalline wax | 3.41 | 3.36 | — | 3.41 | 3.50 | 3.51 |
| | Liquid paraffin | — | — | 3.41 | — | — | — |
| | Sorbitan monooleate | 1.75 | 1.73 | 1.75 | 1.75 | 1.80 | 1.80 |
| | Stearic acid monoglyceride | — | — | — | — | — | — |
| | Glass hollow microspheres | 2.92 | — | 2.92 | 2.92 | — | — |
| | Silica hollow microspheres | — | 4.31 | — | — | — | — |
| | N,N'—dinitrosopentamethylenetetramine | — | — | — | — | 0.20 | — |
| | Density after one day from production | 1.08 | 1.08 | 1.07 | 1.10 | 1.05 | 1.09 |
| Performance | Storage stability in initiation sensitivity (The number of storage months while maintaining complete detonability) | 19 | 16 | 16 | 23 | 14 | 13 |
| | Density at the final complete detonation | 1.09 | 1.08 | 1.09 | 1.12 | 1.11 | 1.13 |

The results of the Examples will be explained by comparing them with the results of Comparative examples.

A W/O emulsion explosive composition of Comparative example 1, which contains neither a specifically limited weak acid salt nor a specifically limited condensed phosphate defined in the present invention, has a storage life of 19 months, within which the explosive composition can be completely detonated at −5° C. by a No. 6 blasting cap. W/O emulsion explosive compositions of Examples 1–5 and 10–14, which contain 0.96% of sodium carbonate, sodium pentaborate, sodium acetate, ammonium silicate or sodium citrate as a specifically limited weak acid salt, or 0.96% of disodium hydrogen phosphate, lithium dihydrogen phosphate, potassium pyrophosphate, ammonium metaphosphate or sodium ultraphosphate as a specifically limited condensed phosphate, have a storage life, within which the explosive composition can be completely detonated at −5° C. by a No. 6 blasting cap, of 27, 26, 27, 26, 26, 29, 27, 29, 30 and 28 months, respectively.

A W/O emulsion explosive composition of Comparative example 2, which contains calcium nitrate as an inorganic oxidizer salt other than ammonium nitrate and silica microballoons having an average particle size of 400 μm as a gas-retaining agent, has a storage life of 16 months, within which the explosive composition can be completely detonated at −5° C. by a No. 6 blasting cap. A W/O emulsion explosive composition of Example 5, which contains 2.80% of potassium pyrophosphate as a condensed phosphate, has a storage life of 25 months, within which the explosive composition can be completely detonated at −5° C. by a No. 6 blasting cap.

A W/O emulsion explosive composition of Comparative example 3, which contains liquid paraffin as a combustible material, has a storage life of 16 months, within which the explosive composition can be completely detonated at −5° C. by a No. 6 blasting cap. A W/O emulsion explosive composition of Example 6, which contains 2.80% of sodium carbonate as a specifically limited weak acid salt, and a W/O emulsion explosive composition of Example 16, which contains 0.96% of potassium pyrophosphate as a condensed phosphate, have storage lives of 22 and 23 months respectively, within which the explosive compositions can be completely detonated at −5° C. by a No. 6 blasting cap.

A W/O emulsion explosive composition of Comparative example 4, which contains 9.44% of sodium nitrate as an inorganic oxidizer salt other than ammonium nitrate, has a storage life of 23 months, within which the explosive composition can be completely detonated at −5° C. by a No. 6 blasting cap. A W/O emulsion explosive composition of Example 7, which contains 0.29% of sodium carbonate as a specifically limited weak acid salt, and a W/O emulsion explosive composition of Example 17, which contains 0.29% of disodium hydrogenphosphate as a condensed phosphate, have storage lives of 32 and 33 months respectively, within which the explosive compositions can be completely detonated at −5° C. by a No. 6 blasting cap.

A W/O emulsion explosive composition of Comparative example 5, whose density has been adjusted by the use of 0.20% of a chemical foaming agent without the use of foam-retaining agent, has a storage life of 14 months, within which the explosive composition can be completely detonated at −5° C. by a No. 6 blasting cap. A W/O emulsion explosive composition of Example 8, which contains 0.99% of ammonium silicate as a specifically limited weak acid salt, and a W/O emulsion explosive composition of Example 18, which contains 0.99% of potassium pyrophosphate as a condensed phosphate, have storage lives of 20 and 21 months respectively, within which the explosive compositions can be completely detonated at −5° C. by a No. 6 blasting cap.

A W/O emulsion explosive composition of Comparative example 6, whose density has been adjusted by mechanically introducing microbubbles without the use of a gas-retaining agent, has a storage life of 13 months, within which the explosive composition can be completely detonated at −5° C. by a No. 6 blasting cap. A W/O emulsion explosive composition of Example 9, which contains 0.99% of sodium carbonate as a specifically limited weak acid salt, and a W/O emulsion explosive composition of Example 19, which contains 0.99% of potassium pyrophosphate as a condensed phosphate, have storage lives of 19 and 20 months respectively, within which the explosive compositions can be completely detonated at −5° C. by a No. 6 blasting cap.

As described above referring to the Examples and Comparative examples, the W/O emulsion explosive composition according to the present invention has a remarkably improved storage stability in its initiation sensitivity in small diameter cartridges and at low temperatures.

What is claimed is:

1. A water-in-oil emulsion explosive composition comprising a disperse phase formed of an aqueous oxidizer solution consisting of (a) an inorganic oxidizer salt selected from the group consisting of ammonium nitrate, and a mixture of ammonium nitrate with at least one of sodium nitrate and calcium nitrate, (b) water and (c) at least one member selected from lithium, sodium, potassium, calcium and ammonium salts of weak acid and condensed phosphoric acid; a continuous phase formed of a combustible material consisting of (d) fuel oil and/or wax; (e) an emulsifier; and (f) hollow microspheres or microbubbles.

2. A water-in-oil emulsion explosive composition according to claim 1, wherein said weak acid is carbonic acid, boric acid, acetic acid, silicic acid or citric acid.

3. A water-in-oil emulsion explosive composition according to claim 1, wherein said hollow microspheres are glass hollow microspheres, silica hollow microspheres, shirasu hollow microspheres or synthetic resin hollow microspheres.

4. A water-in-oil emulsion explosive composition according to claim 1, wherein said microbubbles are microbubbles formed by decomposing and foaming a chemical foaming agent or microbubbles formed by mechanically blowing air into a water-in-oil emulsion.

5. A water-in-oil emulsion explosive composition, comprising 40–90% by weight of an inorganic oxidizer salt selected from the group consisting of ammonium nitrate, and a mixture of ammonium nitrate with at least one of sodium nitrate and calcium nitrate, 7.45–28% by weight of water, 0.05–15% by weight of at least one of lithium, sodium, potassium, calcium and ammonium salts of weak acid and condensed phosphoric acid, 1–10% by weight of at least one of fuel oil and wax, 0.5–5% by weight of an emulsifier, and hollow microspheres or microbubbles in an amount sufficient for adjusting the density of the emulsion explosive composition to 0.80–1.35.

6. A water-in-oil emulsion explosive composition according to claim 5, wherein the amount of at least one of lithium, sodium, potassium, calcium and ammonium salts of weak acid and condensed phosphoric acid is 0.1–5% by weight.

* * * * *